US008894336B1

(12) United States Patent
McThenney

(10) Patent No.: US 8,894,336 B1
(45) Date of Patent: Nov. 25, 2014

(54) SELF-TAPPING AND SEALING REPLACEMENT PLUG

(71) Applicant: Perry McThenney, Palm Bay, FL (US)

(72) Inventor: Perry McThenney, Palm Bay, FL (US)

( * ) Notice: Subject to any disclaimer, the term of this patent is extended or adjusted under 35 U.S.C. 154(b) by 0 days.

(21) Appl. No.: 13/956,854

(22) Filed: Aug. 1, 2013

(51) Int. Cl.
*F16B 43/00* (2006.01)
*F16B 25/10* (2006.01)

(52) U.S. Cl.
CPC ..... *F16B 25/10* (2013.01)
USPC ..... 411/371.1; 411/369

(58) Field of Classification Search
CPC ..... F16B 33/004; F16B 37/00; F16B 37/002; E04D 3/38; E04D 3/3606
USPC ..... 411/178, 369, 371.1, 371.2, 373, 386, 411/418, 542
See application file for complete search history.

(56) References Cited

U.S. PATENT DOCUMENTS 887,962 A * 5/1908 Reisner ..... 16/2.4
2,257,441 A 9/1941 Wylie
2,675,093 A 4/1954 McCall et al.
2,702,201 A * 2/1955 Romanelli et al. ..... 285/8
2,752,814 A * 7/1956 Iaia ..... 411/542
2,795,221 A 6/1957 Braendel
3,099,456 A * 7/1963 Hopp ..... 277/598
3,175,454 A * 3/1965 Morse ..... 411/542
3,472,534 A * 10/1969 Stevens ..... 285/119
4,482,278 A * 11/1984 Dorn ..... 411/377
5,212,971 A 5/1993 Yoon et al.
5,622,464 A * 4/1997 Dill et al. ..... 411/399
5,700,103 A * 12/1997 Tsai ..... 403/260
6,244,807 B1 * 6/2001 Garcia ..... 411/369
6,601,605 B2 8/2003 King, Jr.
7,597,518 B1 * 10/2009 Curtis ..... 411/371.1
7,645,105 B2 * 1/2010 Hengel et al. ..... 411/171
7,819,613 B2 10/2010 Strom
8,262,838 B2 9/2012 Richardson et al.
2002/0096519 A1 7/2002 Joost et al.

* cited by examiner

*Primary Examiner* — Roberta Delisle
(74) *Attorney, Agent, or Firm* — Richard L. Miller

(57) ABSTRACT

A self-tapping and sealing replacement plug for inserting into a circular opening which has a damaged thread, and sealing itself thereon, which has a set of teeth, which teeth have sharp edges for cutting a thread. The plug is sealed on the circular opening by an O-ring, which O-ring is held in a notch between the teeth and the bottom surface of the cap of the plug. The edges of the teeth have leading edges indented towards the center of the plug for facilitating cutting.

21 Claims, 4 Drawing Sheets

SELF-TAPPING AND SEALING REPLACEMENT PLUG

BACKGROUND OF THE INVENTION

1. Field of the Invention

The present invention relates to a fluid tight plugs for sealing orifices, and more particularly, a self-tapping and sealing replacement plug.

2. Description of the Prior Art

Numerous innovations for replacement plugs have been provided in the prior art that will be described. Even though these innovations may be suitable for the specific individual purposes to which they address, however, they differ from the present invention.

A FIRST EXAMPLE, U.S. Pat. Office Document No. 2,257,441, Published/Issued on Sep. 30, 1941, to Wylie teaches a self-tapping bold, and more specifically the production of an overside self-tapping drain plug or bolt A SECOND EXAMPLE, U.S. Pat. Office Document No. 2,675,093, Published/Issued on Apr. 13, 1954, to McCall, et al. teaches fittings for containers such as fluid containers, and especially such fittings as closure caps and filtering attachments, an object being to provide means for filtering dust, dirt, bean fuzz, etc., from replacement air as it enters such container through the cap or filter fitting; to absorb some moisture from such air at the same time and prevent the loss of fluids and volatile gasses from said container through the cap or fitting when the same is being bumped about in service.

A THIRD EXAMPLE, U.S. Pat. Office Document No. 2,795,221, Published/Issued on Jun. 11, 1957, to Braendel teaches an insert suitable for ready self tapping installation into the bored aluminum head of an internal combustion engine, which despite its self-tapping conformation does not leave any voids to trap combustible mixture and thus does not result in objectionable pre-ignition or knocking.

A FOURTH EXAMPLE, U.S. Pat. Office Document No. 5,212,971, Published/Issued on May 25, 1993, to Yoon, et al. teaches a fuel tank plug structure has a cap assembly provided with a cap member and a push button combination lock, a fixing plate including a lever for cooperating with the push button combination lock, an intermediate portion below the fixing plate defining a interior storage compartment adapted to contain articles such as keys, money, etc., a clogging assembly provided with a tubular portion including a lower engaging portion configured to be removably, received on, so as to close, a container or vehicle fuel tank filler neck and a supporting member causing the intermediate portion to be engaged with the tubular portion through a sealing member. The push button combination lock has a slider which will engage the fixing plate with the intermediate portion upon depressing a correct series of buttons and will disengage the cap member from the intermediate portion when the correct series of buttons are not depressed. Therefore, when the cap member is disengaged with the intermediate portion, it rotates freely to prevent removal of the fuel tank plug structure from the container and access to the hidden article and to the container contents. On the contrary, when the cap member is engaged, the whole fuel tank plug structure can be rotated as a single unit allowing the cap assembly to be installed or removed from the container or fuel tank filler neck to gain access to the container and to the storage compartment of the fuel tank plug structure.

A FIFTH EXAMPLE, U.S. Pat. Office Document No. 6,601,605, Published/Issued on Aug. 5, 2003, to King, Jr. teaches an end-cap lockingly securable to the end of the pipe at the same time a secondary action such as a branch line is formed to the main pipe line. The end cap housing has an integral branch forming member to allow a user to lock the end cap to the pipe by forming a branch line on the side of the pipe with the end cap housing sandwiching the end of a pipe between a pipe insert and a pipe receptor in the end cap housing. The pipe receptor includes an insert having a sealing surface, which when engaged to the interior surface of a pipe, forms a leak-proof relationship with the pipe.a A SIXTH EXAMPLE, U.S. Pat. Office Document No. 7,819,613, Published/Issued on Oct. 26, 2010, to Strom teaches a self-tapping insert is installed in a pre-existing bore hole in a workpiece by rotating the insert, causing cutting threads on the exterior of the self-tapping insert to cut new threads. Engagement threads on the exterior of the self-tapping insert engage the new threads to retain the self-tapping insert within the workpiece. The self-tapping insert may comprise internal threads which are used to replaced damaged threads in the workpiece. The exterior threads of the self-tapping insert may be configured as left-handed threads, while the internal threads are right-handed threads. The top of the self-tapping insert may comprise a plurality of castellations, and a drive head having matching castellations may be employed to install the self-tapping insert, eliminating the need for installing the insert with a drive bolt. The exterior of the self-tapping insert may further comprise a leading edge for cutting the new threads, where the leading edge has greater radial extension than the trailing edge. This feature provides greater chip relief, thereby reducing the torque required to install the self-tapping insert.

A SEVENTH EXAMPLE, U.S. Pat. Office Document No. 8,262,838, Published/Issued on Sep. 11, 2012, to Richardson, et al. teaches a fusible completion plug and method for its use includes a cylindrical plug body having a lower portion that includes a fusible element in communication with an electric power supply. The completion plug also includes an elastomeric seal that provides for a temporary seal. A pressure balancing port and equalization valve are provided to relieve the differential pressure across the completion plug as the plug is positioned in place. The pressure equalization valve also includes a fusible element for fusing the valve within the port, thereby preventing a leak path through the plug body. A blind flange may be installed above the completion plug in case the plug fusion fails. The blind flange may be a traditional blind flange or may be a fusible blind flange.

AN EIGHTH EXAMPLE, U.S. Pat. Office Document No. 20020096519, Published/Issued on Jul. 25, 2002, to Joost, et al. teaches in order to make available a tank cap with a sealing plug (13, 15; 18, 21) and a filler opening (10) in the fuel tank, which allows a simplified production and a more flexible use, it is proposed that the filler opening (10) is configured in such a way that the filler opening (10) allows the fixing of a sealing plug (13, 15; 18, 21) by means of two fixing systems or more.

It is apparent now that numerous innovations for self-tapping plugs have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a SELF-TAPPING AND SEALING REPLACEMENT PLUG that avoids the disadvantages of the prior art.

ANOTHER OBJECT of the present invention is to provide a SELF-TAPPING AND SEALING REPLACEMENT PLUG that is simple and inexpensive to manufacture.

STILL ANOTHER OBJECT of the present invention is to provide a SELF-TAPPING AND SEALING REPLACEMENT PLUG that is simple to use.

BRIEFLY STATED, STILL YET ANOTHER OBJECT of the present invention is to provide a SELF-TAPPING AND SEALING REPLACEMENT PLUG that allows insertion to and removal from an opening that has a damaged thread, and that when inserted forms a fluid-tight seal.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Figure 1:
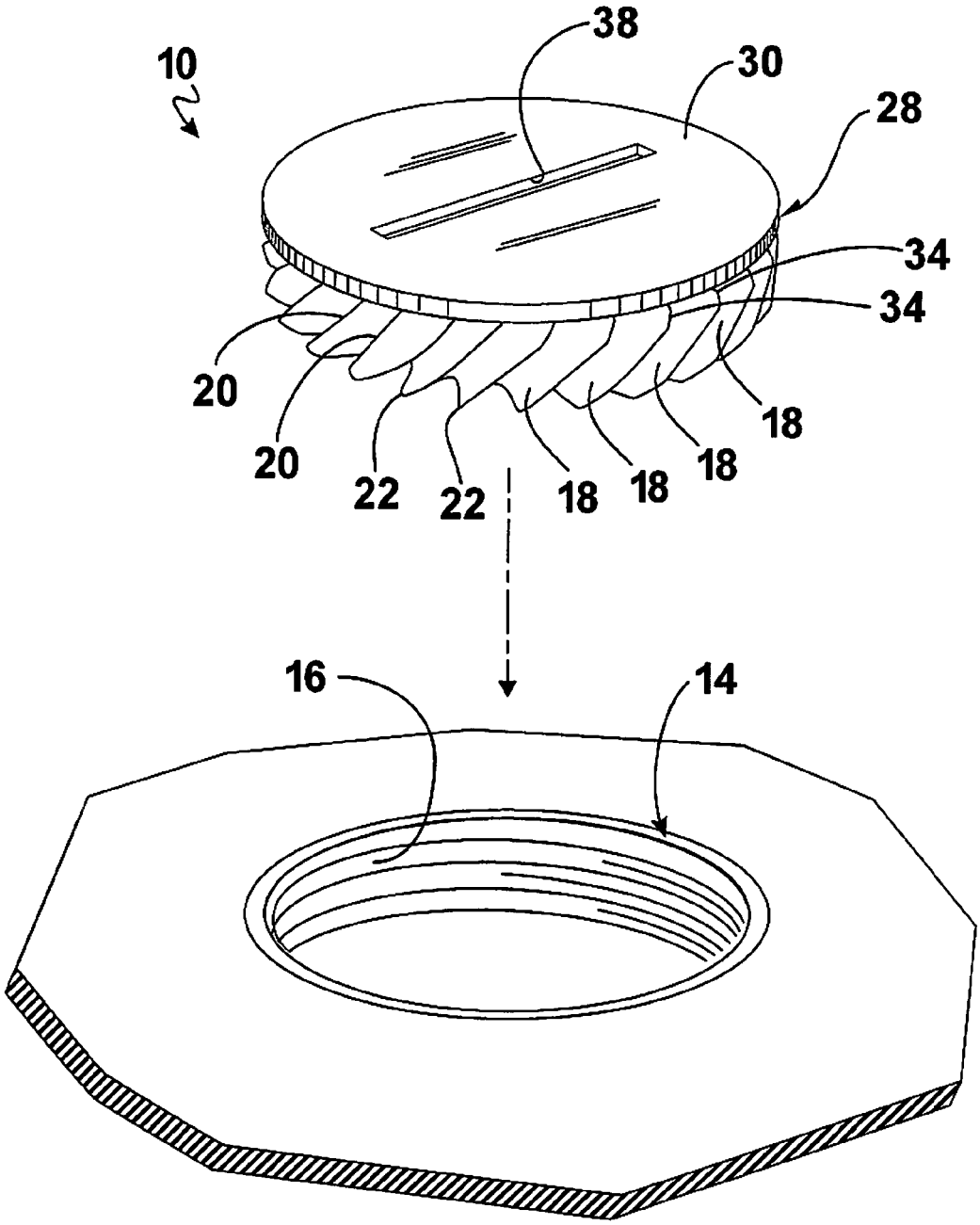
FIG. 1 is a diagrammatic perspective view illustrating the self-tapping and sealing replacement PLUG being installed in a typical round opening, when the threads of the orifice are damaged or when it is desired that the plug can be removed/installed by just turning it a fraction of a single revolution.

10 plug;
12 O-ring;
14 circular opening;
16 damaged thread of circular opening 14;
18 starts or teeth of plug 10;
20 edges of teeth 18 of plug 10;
22 leading edges of edges 20 of teeth 18 of plug 10;
24 angle of offset of edges 20 of teeth 18 of plug 10;
26 height of plug 10;
28 cap of plug 10;
30 top surface of cap 28 of plug 10;
32 bottom surface of cap 28 of plug 10;
34 notch of edges 20 of teeth 18 of plug 10;
36 channel formed by notch 34 of edges 20 of teeth 18 of plug 10 and bottom surface 32 of cap 28 of plug 10;
38 rectangular groove in top surface 30 of cap 28 of plug 10;
40 center of plug 10. and
42 axis of plug 10

DETAILED DESCRIPTION OF THE PREFERRED EMBODIMENT

Figure 2:
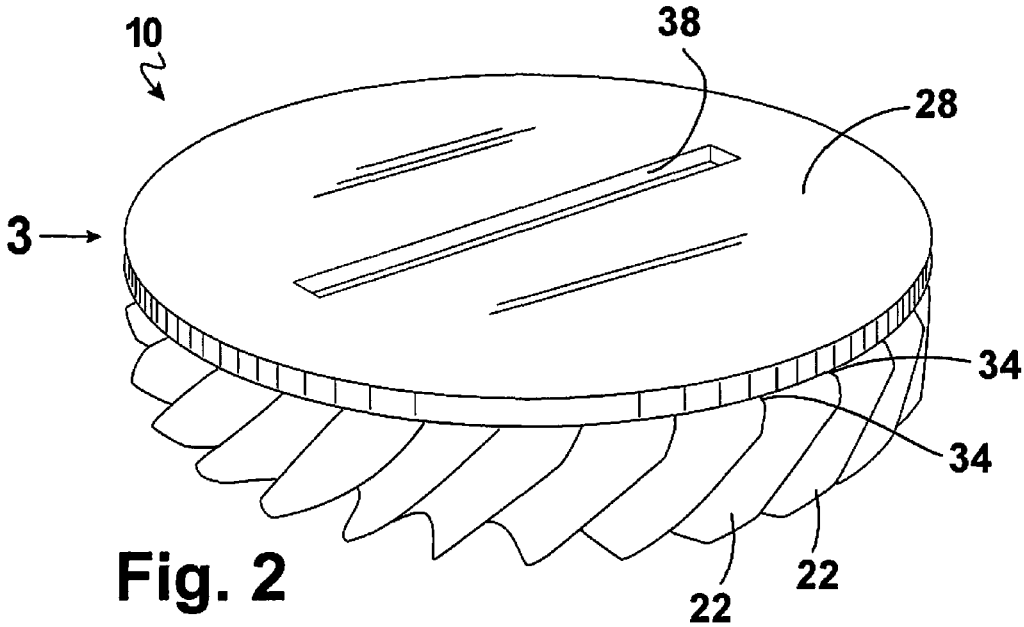
FIG. 2 is a diagrammatic perspective view illustrating the self-tapping and sealing replacement plug per se.
Figure 3:
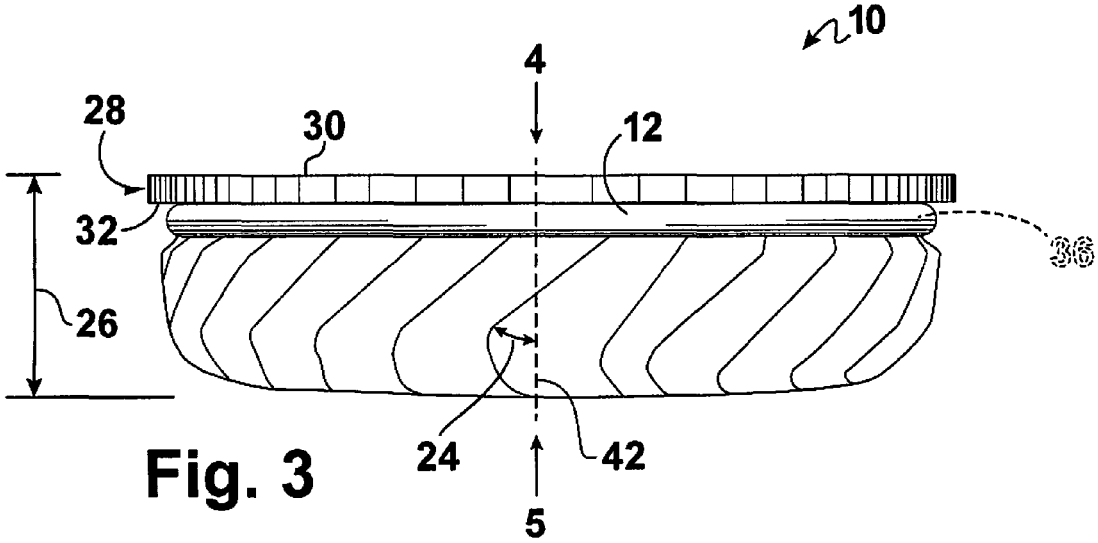
FIG. 3 is a side elevational view taken in the direction of arrow 3 in FIG. 2.
Figure 4:
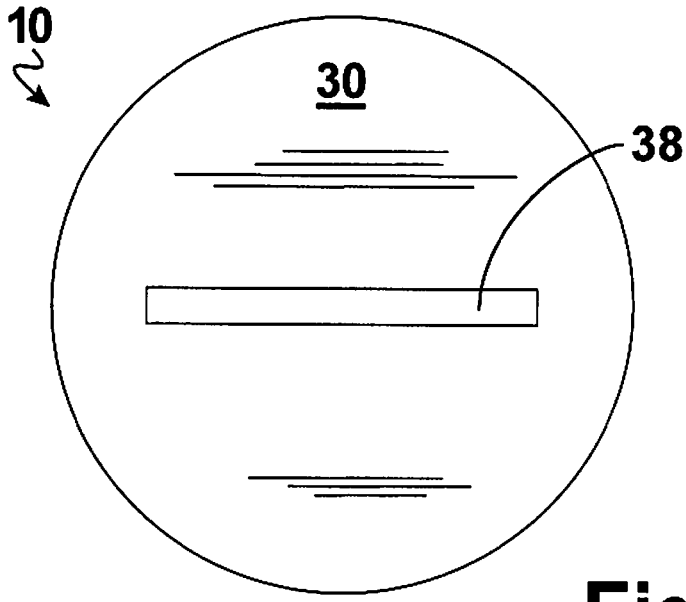
FIG. 4 is a top plan view taken in the direction of arrow 4 in FIG. 3.

Referring now to the figures, in which like numerals indicate like parts, and particularly to FIGS. 1-3, shown is a self-tapping and sealing replacement plug 10 which comprises a plug 10 and an O-ring 12. The plug 10 comprises a plurality of teeth 18 and a cap 28. The plug 10 is for sealing a circular opening 14. The O-ring 12 is for providing a fluid-tight seal when the plug 10 seals the circular opening 14. The cap 28 provides the sealing of the circular opening 14. The teeth 18 are for self-tapping of a thread in the circular opening 14.

Figure 5:
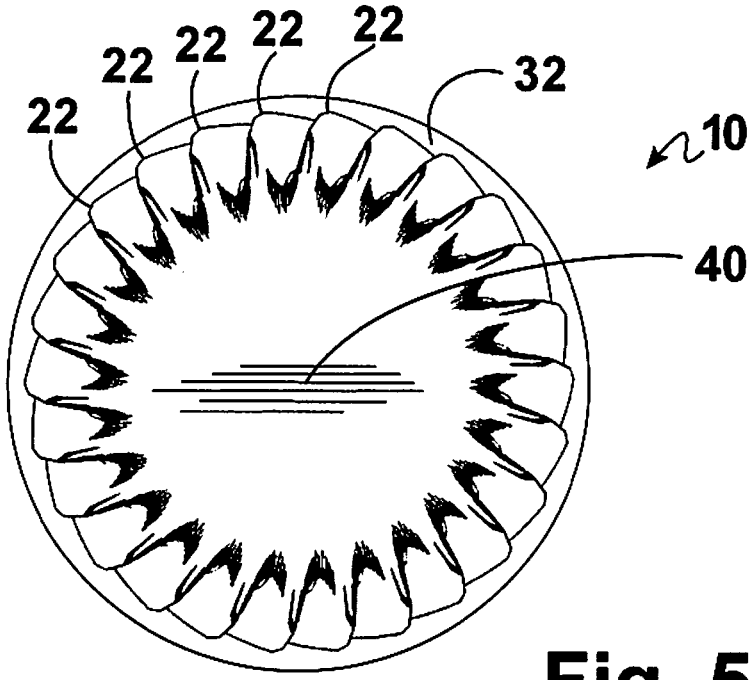
FIG. 5 is a bottom plan view taken in the direction of arrow 5 in FIG. 3.

As best seen in FIG. 5 it will be observed that the particular embodiment of the plug illustrated has TWENTY SIX starts or teeth 18 which allows the plug 10 to tap a set new threads (not shown) into a damaged orifice by applying just axially force with a zero amount of applied torque. The number of teeth on the plug must be at least THREE and may be considerably more as long as the angle 24 of the offset of the edges of teeth 18 with respect to the axis 42 of plug 10 is not much greater than EIGHTY degrees. If the angle 24 is larger then both torque and axial force will be required to cause the plug the tap threads into a damaged orifice.

The self-tapping can be performed even where a damaged thread 16 exists already inside the circular opening 14. To accomplish this, the teeth 18 have edges 20 which are for cutting the thread to accomplish the self-tapping of a thread in the circular opening 14. To do this, the edges 20 of the teeth 18 are sharp, so that they can more easily cut the a new set of threads (not shown) in the circular opening 14. Further, the edges 20 of the teeth 18 have leading edges 22, the leading edges 22 being indented so as to facilitate cutting of a thread. The leading edges 22 of the edges 20 of the teeth 18 are sloped inward towards the center of the plug 40. The plug has a height 26, and the edges 20 of the teeth 18 are offset at an angle 24 which is diagonal with respect to the height 26. The angle 24 at which the edges 20 of the teeth 18 are offset with respect to an axis of the plug is between TEN degrees and EIGHTY degrees. The range of angles 24 with respect to the height 26 allows the plug to be inserted with only a partial rotation.

Figure 6:
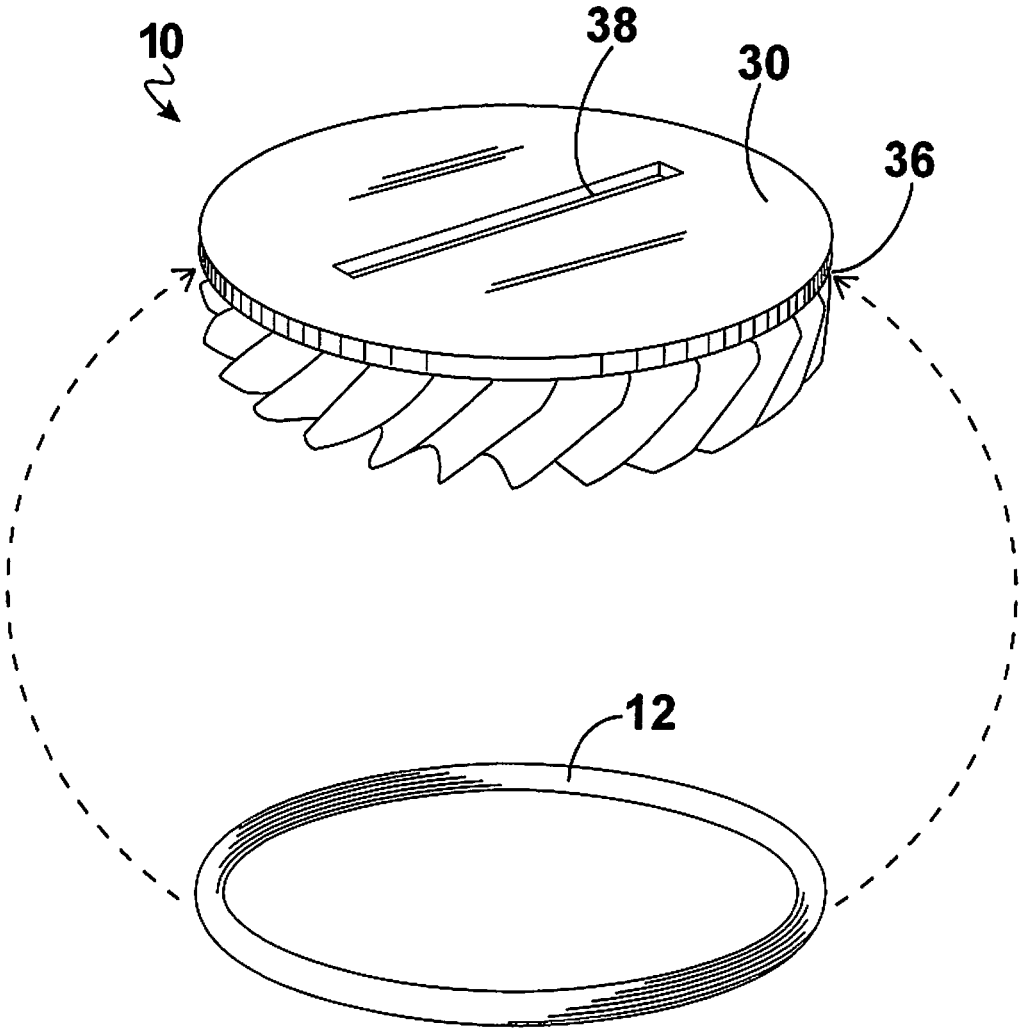
FIG. 6 is a diagrammatic perspective view illustrating how an O-ring may be stretched around and inserted in a grooved area when it is desired that the device seals the orifice to prevents fluids seeping through the orifice.

Referring now to FIGS. 3-6, shown is the self-tapping and sealing replacement plug 10, where the cap 28 has a top surface 30 and a bottom surface 32. The teeth 18 come into contact with the bottom surface 32 of the cap 28. The edges 20 of the teeth 18 are notched 34 away before coming into contact with the bottom surface 32 of the cap 28. The notches 34 of the edges correspond with one another so as to form part of a channel 36 along the tops of the teeth 18, and the bottom surface 32 of the cap 28 forms the remainder of the channel 36. As seen in FIGS. 3 and 6, the channel 36 is for accommodating the O-ring 12. As best seen in FIGS. 1, 2, 4, and 6, the top surface 30 of the cap has a rectangular groove 38 cut therein in which an appropriate tool may be inserted (not shown) for facilitating twisting the plug 10, when it is required to remove the plug or in the alternative to tighten it further.

It will be understood that each of the elements described above, or two or more together, may also find a useful application in other types of constructions differing from the types described above.

While the invention has been illustrated and described as embodiments of a self-tapping and sealing replacement plug, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A self-tapping and sealing replacement plug comprising:
a) a plug; and
b) an O-ring;
wherein said plug comprises:
c) a plurality of teeth; and
d) a cap;
wherein said cap has:
e) a top surface; and
f) a bottom surface;
wherein said teeth come into contact with said bottom surface of said cap;
wherein said edges of said teeth are notched away before coming into contact with said bottom surface of said cap
wherein said notches of said edges correspond with one another so as to form part of a channel along the tops of said teeth; and
wherein said bottom surface of said cap forms the remainder of said channel,
wherein said plug is for sealing a circular opening;
wherein said O-ring is for providing a fluid-tight seal when said plug seals the circular opening;
wherein said cap provides said sealing of the circular opening; and
wherein said set of teeth are for self-tapping of a thread in said circular opening.

2. The self-tapping and sealing replacement plug of claim 1, wherein said teeth have edges; and
wherein said edges of said teeth are for cutting said thread to accomplish said self-tapping of a thread in said circular opening.

3. The self-tapping and sealing replacement plug of claim 2, wherein said edges are sharp.

4. The self-tapping and sealing replacement plug of claim 3, wherein said edges of said teeth have leading edges;
wherein said leading edges are portions of said edges of said teeth; and
wherein said leading edges are for beginning cutting said thread to accomplish said self-tapping of a thread in said circular opening.

5. The self-tapping and sealing replacement plug of claim 4, wherein said plug has a center; and
wherein said leading edges of said teeth edges are sloped inward towards the center of the plug.

6. The self-tapping and sealing replacement plug of claim 5, wherein said plug has a height;
wherein said edges of said teeth are offset at an angle which is diagonal with respect to said height; and
wherein said angle at which said edges of said teeth are offset with respect to an axis of said plug is between 10 degrees and 80 degrees.

7. The self-tapping and sealing replacement plug of claim 1, wherein said channel is for accommodating said O-ring.

8. The self-tapping and sealing replacement plug of claim 7, wherein said top surface of said cap has a groove cut therein; and
wherein said groove is for facilitating twisting said plug.

9. The self-tapping and sealing replacement plug of claim 8, wherein said grove cut in said top surface of said cap is rectangular.

10. The self-tapping and sealing replacement plug of claim 1, wherein said plurality of teeth is at least three.

11. A self-tapping and sealing replacement plug, comprising:
a) a plug; and
b) an O-ring;
wherein said plug comprises:
c) a plurality of teeth; and
d) a cap;
wherein said plug is for sealing a circular opening;
wherein said O-ring is for providing a fluid-tight seal when said plug seals the circular opening;
wherein said cap provides said sealing of the circular opening;
wherein said set of teeth are for self-tapping of a thread in said circular opening; and
wherein all said teeth depend a same distance as each other from said cap.

12. The self-tapping and sealing replacement plug of claim 11, wherein said teeth have edges; and
wherein said edges of said teeth are for cutting said thread to accomplish said self-tapping of a thread in said circular opening.

13. The self-tapping and sealing replacement plug of claim 12, wherein said edges are sharp.

14. The self-tapping and sealing replacement plug of claim 13, wherein said edges of said teeth have leading edges;
wherein said leading edges are portions of said edges of said teeth; and
wherein said leading edges are for beginning cutting said thread to accomplish said self-tapping of a thread in said circular opening.

15. The self-tapping and sealing replacement plug of claim 14, wherein said plug has a center; and
wherein said leading edges of said teeth edges are sloped inward towards the center of the plug.

16. The self-tapping and sealing replacement plug of claim 15, wherein said plug has a height;
wherein said edges of said teeth are offset at an angle which is diagonal with respect to said height; and
wherein said angle at which said edges of said teeth are offset with respect to an axis of said plug is between 10 degrees and 80 degrees.

17. The self-tapping and sealing replacement plug of claim 13, wherein said cap has:
a) a top surface; and
b) a bottom surface;
wherein said teeth come into contact with said bottom surface of said cap;
wherein said edges of said teeth are notched away before coming into contact with said bottom surface of said cap
wherein said notches of said edges correspond with one another so as to form part of a channel along the tops of said teeth; and
wherein said bottom surface of said cap forms the remainder of said channel.

18. The self-tapping and sealing replacement plug of claim 17, wherein said channel is for accommodating said O-ring.

19. The self-tapping and sealing replacement plug of claim 18, wherein said top surface of said cap has a groove cut therein; and
wherein said groove is for facilitating twisting said plug.

20. The self-tapping and sealing replacement plug of claim 19, wherein said grove cut in said top surface of said cap is rectangular.

21. The self-tapping and sealing replacement plug of claim 11, wherein said plurality of teeth is at least three.

* * * * *